US012514317B1

(12) United States Patent
Bowden

(10) Patent No.: US 12,514,317 B1
(45) Date of Patent: Jan. 6, 2026

(54) CONTINUOUS WEFT HAIR EXTENSION DISPENSING DEVICE AND COMPONENTS THEREOF

(71) Applicant: Bowden Consulting LLC, Colorado Springs, CO (US)

(72) Inventor: Jenna Bowden, Colorado Springs, CO (US)

(73) Assignee: Bowden Consulting LLC, Colorado Springs, CO (US)

( * ) Notice: Subject to any disclaimer, the term of this patent is extended or adjusted under 35 U.S.C. 154(b) by 0 days.

(21) Appl. No.: 19/180,979

(22) Filed: Apr. 16, 2025

(51) Int. Cl.
*A41G 5/00* (2006.01)

(52) U.S. Cl.
CPC ..... *A41G 5/004* (2013.01)

(58) Field of Classification Search
CPC ..... B65H 49/06; B65H 49/08; B65H 63/08; B65H 61/00; D05B 91/14; D05B 91/16; D05B 43/00; A41G 5/004; A41G 5/00; A41G 5/0046; A41G 5/0053; A41G 5/006; A45D 44/04
USPC ..... 225/16, 17, 18, 46, 59; 83/649, 937, 83/949; 242/134–141; 223/106, 107
See application file for complete search history.

(56) References Cited

U.S. PATENT DOCUMENTS 1,107,052 A * 8/1914 Eiberle ..... A41G 3/00 132/56
2,447,145 A * 8/1948 Van Cleef et al. ..... B65H 35/0093 225/80
2,621,663 A * 12/1952 Jenkins ..... A41G 5/006 132/201
2,695,621 A * 11/1954 Cox ..... A63H 3/44 132/201
5,722,434 A * 3/1998 Walker ..... A41G 5/0073 132/54
9,220,329 B1 * 12/2015 Kim ..... B65D 85/18
2010/0132826 A1 * 6/2010 Chang ..... A41G 5/0046 139/451
2016/0219958 A1 * 8/2016 Wang ..... B65D 5/5035
2016/0295945 A1 10/2016 Choi
2018/0055196 A1 * 3/2018 Glover ..... A41G 5/004
2020/0260841 A1 * 8/2020 Kennebrew ..... A41G 3/0066
2021/0169202 A1 * 6/2021 Duffus ..... A45D 44/04
2022/0248829 A1 * 8/2022 Williams ..... B65H 35/008

OTHER PUBLICATIONS

Clarivate Analytics copyrighted translation of JP2006525037A; publication date Nov. 9, 2006 (Year: 2006).*
Clarivate Analytics copyrighted translation of JPH0594226U; publication date Dec. 24, 1993 (Year: 1993).*
Clarivate Analytics copyrighted translation of JP05078901A; publication date Mar. 30, 1993 (Year: 1993).*

* cited by examiner

*Primary Examiner* — Tatiana L Nobrega
*Assistant Examiner* — Sarah Woodhouse
(74) *Attorney, Agent, or Firm* — Dentons US LLP

(57) ABSTRACT

A device for storing a weft hair extension includes a base, a spool with a body having an outer surface around which the weft hair extension is wrapped, and a basin positioned below the spool and configured to receive ends of the strands of hair of the weft hair extension held by the spool, such that the ends of the strands of hair are contained within the basin.

16 Claims, 3 Drawing Sheets

CONTINUOUS WEFT HAIR EXTENSION DISPENSING DEVICE AND COMPONENTS THEREOF

TECHNICAL FIELD

This disclosure relates generally to tools for managing and using hair extensions. More particularly, in some embodiments, this disclosure relates to a continuous weft hair extension dispensing device.

BACKGROUND

A weft hair extension is a set of hair strands (human or synthetic) attached to a strip of fabric or other material. The strip of fabric can be attached to a user's natural hair to add length, volume, and/or color. Weft hair extensions can be attached to the user's hair using various methods, including bonding, sewing, clips, and adhesives. Sew-in wefts may be sewn into braids or tracks of natural hair. Bonding wefts may be attached using a heat-activated adhesive or bonding agent, while tape-in wefts may be attached using an adhesive tape. Clip-in wefts are attached using clips that attach to the hair.

Weft hair extensions are typically commercially available in packages with a predefined length (e.g., from 10 inches to 22 inches) and color of hair attached to a pre-cut strip of fabric of a certain width (e.g., from 10 inches to 48 inches). The width of the strip of fabric on which the hair strands are attached defines the width of the weft hair extension, while the length of the hair strands defines the length of the weft hair extension.

Weft hair packages, especially pre-taped or pre-bonded ones, are not easily customizable in terms of length or volume. If a client's needs are slightly different than the package offers, it may not be possible to adjust them. Thus, if the wefts are too long for the client's needs, some of the hair will be cut off and discarded. This could mean a loss of 10-20% of the total hair, depending on the length and desired style. Additionally, for clients with thick or long hair, multiple weft hair packages may be needed. In many cases, not all of the second or third package is used resulting in wastage. When the additional pieces are not needed, they are often discarded. This is common with pre-taped or clip-in wefts where only a few are required for the style. Hair wefts, especially human hair, are expensive and can cost hundreds of dollars or more depending on quality and length. Accordingly, there is a need for improved packaging, management, and storage of weft hair extensions in order to reduce waste and cost.

SUMMARY

The present disclosure recognizes previously unidentified problems associated with the packaging, management, and storage of weft hair extensions that are provided to consumers in packages containing extensions in pre-cut wefts. For example, since each user (e.g., a client at a salon) may only need a relatively small width of a given color of a weft hair extension, the remaining unused portions of the weft are typically discarded, resulting in both material waste and increased cost. For instance, if a blend of multiple colors is desired for a given hair style, the unused portions of the weft for each color in the blend may be wasted. These limitations of material waste and increased cost may result in bottlenecks to providing desired colors and styles to clients. Repeated shipping of packages of small sets of pre-cut wefts also results in a negative environmental impact through increased carbon footprint of wasted packaging and repeated shipping. Salon operators may also have difficulty managing inventory of pre-cut weft hair extensions given that need for certain colors and hair lengths can be sporadic. Pre-cut weft hair extensions can also be difficult to sort and handle, resulting in inefficiencies during use of the pre-cut weft hair extensions to create a hair style.

This disclosure provides solutions to the problems of previous weft hair extension management technology, including those newly identified problems described above, by providing a continuous weft hair extension dispenser device. The disclosed device may reduce or even eliminates hair waste because a stylist can dispense only the width of a certain hair extension color/size that is needed without subsequently discarding the remaining unused portion of the weft hair extension, as is the case with pre-cut weft hair extensions. By having a wider weft hair extension on a spool, packaging and shipping resources and costs can be saved, resulting in more sustainable and efficient operations. By allowing spools with different hair colors and lengths to be accessed (e.g., as interchangeable hair extension cartridges), the disclosed device can improve inventory management, while also enabling stylists to easily and efficiently combine a range of colors/lengths to achieve a broader range of potential hair styles without material waste. The disclosed device may also be easier to work with than loose weft hair extensions, which can become tangled and can be difficult to cut to size.

In some embodiments, the continuous weft hair extension dispenser device of this disclosure is compact, such that weft hair extensions can be stored and released from the dispenser in a relatively small footprint. For example, the device may be smaller than the length of the hair in the hair extension. Rather than allowing the hair to dangle freely in the workspace and potentially become tangled or damaged, the extra length of hair that extends beyond the end of the device may be contained within a well in which the extra length of hair can pool. In some embodiments, spools storing different colors and/or lengths of weft hair extensions are interchangeable cartridges, such that a single dispenser device can be used to dispense a range of hair colors and lengths by simply changing out the cartridges. In some embodiments, a cover protects the weft hair extensions from exposure to light and/or other environmental elements to help protect the hair extensions and extend their shelf life (e.g., by limiting impacts of light and dust exposure and/or repeated incidental contact by users, all of which may impact hair quality over time). This cover may be part of the dispenser. In some embodiments, a specially structured container is provided that stores and protects not in use hair extension cartridges.

In an aspect, the present disclosure provides a device for storing a weft hair extension. The device comprises a base; a spool comprising a body having an outer surface around which the weft hair extension is wrapped, the body comprising at least one attachment end configured to couple the spool to the base such that the spool is rotatable; and a basin positioned below the spool and configured to receive ends of strands of hair of the weft hair extension held by the spool, such that the ends of the strands of hair are contained within the basin.

In some embodiments, a length of the device is less than a length of the strands of hair of the weft hair extension. In some embodiments, the at least one attachment end of the spool is an opening through which a pole or tab attachment of the base fits. In some embodiments, the at least one attachment end of the spool is a tab fittable in a depression of the base, wherein the depression is shaped to interlock with the tab.

In some embodiments, the device further comprises a measuring tool extending from the base, wherein the measuring tool is configured to enable a user to measure a width of the weft hair extension unrolled from the spool. In some embodiments, the device further comprises a cutting tool coupled to the base or the measuring tool, wherein the cutting tool is configured to enable a user to cut the width of the weft hair extension unrolled from the spool.

In some embodiments, the basin is coupled to the base. In some embodiments, the basin is directly coupled to the spool. In some embodiments, the outer surface of the spool comprises a holder to hold an end of a strip of the weft hair extension in place. In some embodiments, the spool is removable and replaceable on the base. In some embodiments, the base is mountable to at least one of a wall, table, rack, or stand. In some embodiments, the device is portable.

In another aspect, the present disclosure provides a cartridge holding a weft hair extension, the cartridge comprising: a spool comprising: a body having an outer surface around which the weft hair extension is wrapped; and at least one attachment end configured to couple to a base, such that the spool is rotatable on the base; and a basin positioned below the spool and configured to receive ends of strands of hair of the weft hair extension, such that the ends of the strands of hair are contained within the basin.

In some embodiments, a length of the cartridge is less than a length of the strands of hair of the weft hair extension. In some embodiments, the at least one attachment end is an opening through which a corresponding attachment of the base fits or a tab which fits within the corresponding attachment of the base. In some embodiments, the outer surface of the spool comprises a holder to hold an end of the strip of the weft hair extension in place. In some embodiments, the cartridge is removable and replaceable on the base. In some embodiments, the cartridge further comprises a cover fittable over the spool, wherein the cover couples to the basin to protect the weft hair extension held by the cartridge.

In yet another aspect, the present disclosure provides a container for storing a cartridge holding a weft hair extension, the cartridge comprising a spool with a body having an outer surface around which the weft hair extension is wrapped and an attachment end, wherein the weft hair extension comprises strands of hair attached to a strip, the container comprising: a spool attachment raised from an inner surface of the container, wherein the spool attachment is configured to reversibly couple to the attachment end of the cartridge such that a space is provided below the spool attachment to contain ends of the strands of hair, wherein a length of the container is less than a length of the strands of hair of the weft hair extension. In some embodiments, the container is opaque.

Other systems and devices according to embodiments of the present disclosure will be apparent to a person skilled in the art upon review of the following drawings and detailed description. It is intended that all such additional systems and devices be included within this description and within the scope of this disclosure.

BRIEF DESCRIPTION OF THE DRAWINGS

Non-limiting and non-exhaustive examples are described with reference to the following figures.

DETAILED DESCRIPTION

In the following detailed description, references are made to the accompanying drawings that form a part hereof, and in which are shown by way of illustrations specific embodiments or examples. These aspects may be combined, other aspects may be utilized, and structural changes may be made without departing from the present disclosure. Examples may be practiced as methods, systems, or devices. The following detailed description is therefore not to be taken in a limiting sense, and the scope of the present disclosure is defined by the appended claims and their equivalents.

Figure 1:
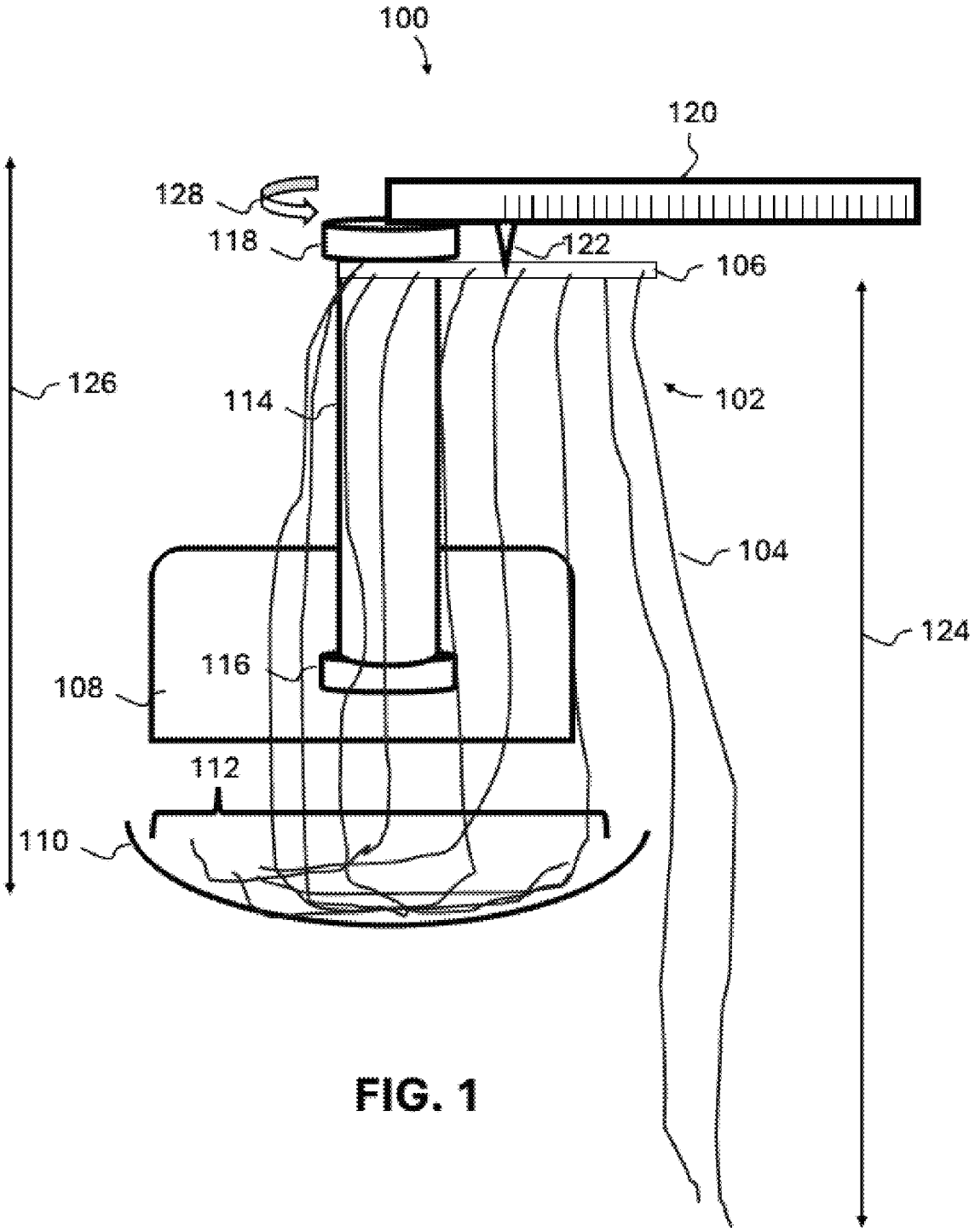
FIG. 1 is a diagram showing a weft dispensing device, according to an embodiment of the present disclosure.

FIG. 1 shows an exemplary weft hair extension dispensing device 100. As described above, the device 100 provides several benefits over previous technologies. For example, by minimizing packaging waste and enabling bulk purchasing, the device 100 offers a cost-effective, sustainable, and scalable solution, which, as an example, may be used in high-volume salons that provide hair extension styling. The device 100 may allow improved storage and dispensing of weft hair extensions 102. The device 100 may allow hair extension inventory management to be streamlined.

As described further below, the device 100 includes a continuous roll of weft hair extensions 102 wound onto a spool 114, allowing stylists or other users to pull, measure, and cut a desired amount of the weft hair extension 102 that is needed for a given use (e.g., for a given style for a client). The device 100 may reduce material waste while also improving operating efficiency. For example, unlike traditional pre-cut wefts, which often result in leftover unusable portions, the device 100 allows customizable widths of a weft hair extension 102 to be obtained without the user needing to discard unused portions of a pre-cut weft hair extension. This can allow stylists to blend different hair colors more seamlessly without wasting materials or encountering exorbitant material costs.

Figure 2:
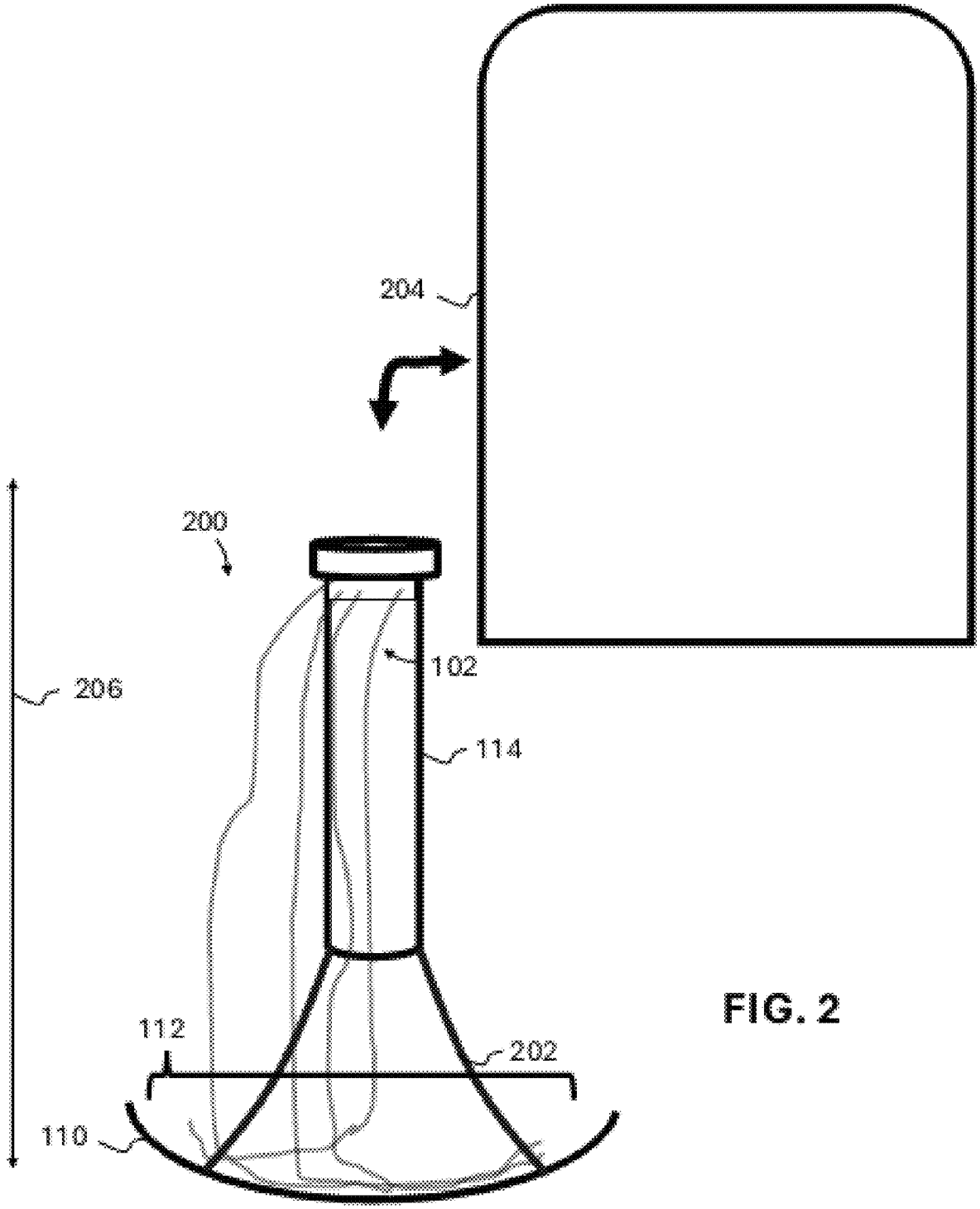
FIG. 2 is diagram illustrating an exemplary hair extension cartridge, according to an embodiment of the present disclosure.
Figure 3:
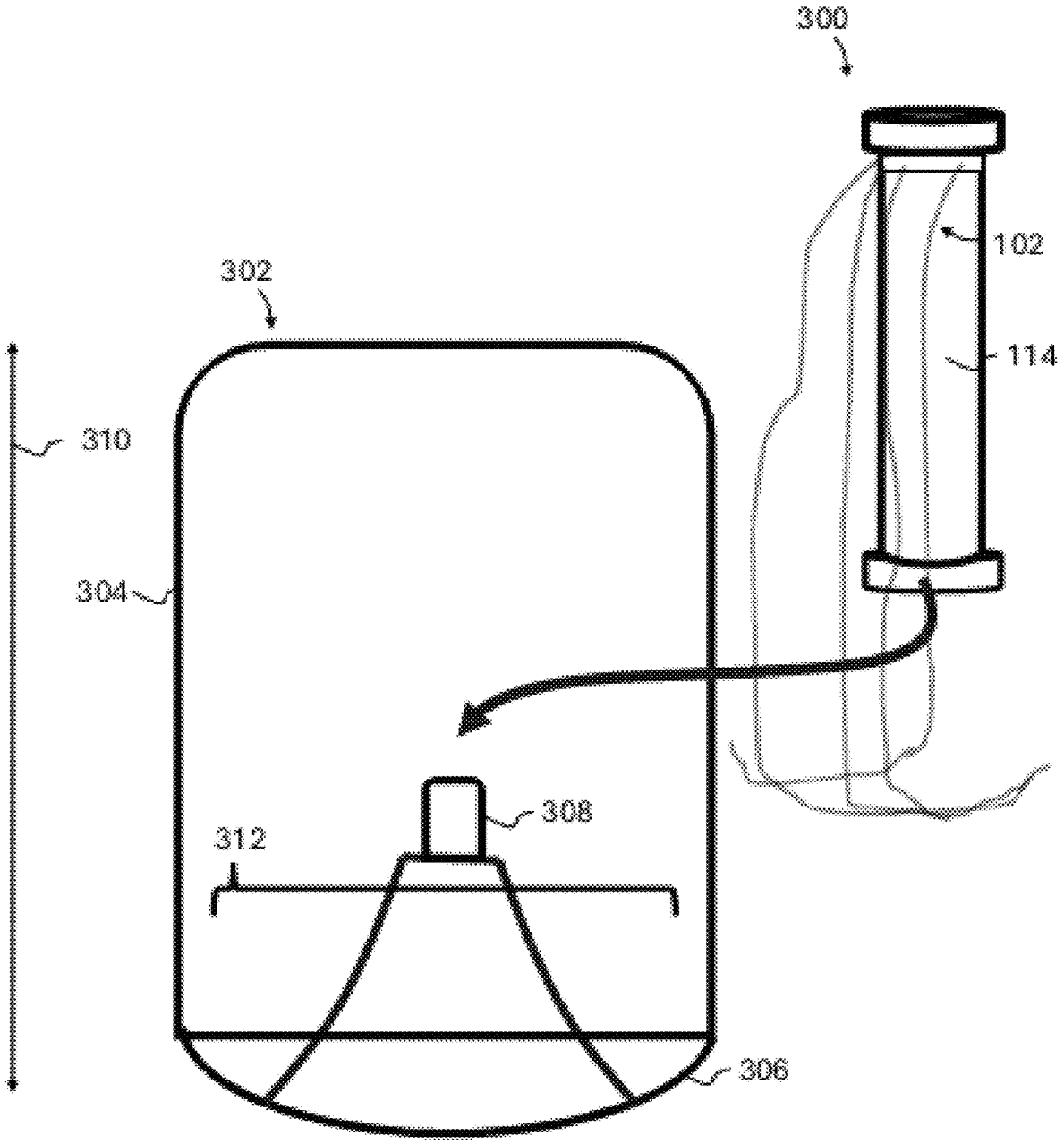
FIG. 3 is diagram illustrating another exemplary hair extension cartridge and a cartridge holder, according to an embodiment of the present disclosure.

The device 100 may also improve organization within a salon. For example, the spool 114 of the device 100 may be designed to be housed in a dedicated rack (e.g., as cartridges-see FIGS. 2 and 3), or the base 108 may be mounted in an operationally convenient location, such as on a work table, wall, stand, or the like, keeping hair extensions easily accessible, tangle-free, and protected from contamination (e.g., by a cover as shown in the examples of FIGS. 2 and 3). The device 100 is generally simple to operate, allowing a user, such as a stylist, to easily manage different hair extension types and dispense desired amounts of these hair extensions. The device 100 may not include a motor or complex gears, allowing users to operate the device 100 more easily while also reducing downtime due to possible malfunctions of such components.

The device 100 includes a base 108, a spool 114 attached to the base 108, and a basin 110 positioned below the spool 114 to receive ends of the strands of hair 104 (human hair or synthetic hair) of the weft hair extension 102 held by the spool 114, such that the ends of the strands of hair 104 are contained within the basin 110. The device 100 may further include a measuring tool 120 and/or a cutting tool 122.

The weft hair extension 102 includes strands of hair 104 attached to a strip 106. For example, the strip 106 may be a length of fabric on which the strands of hair 104 are sewn or otherwise attached. The weft hair extension 102 may be of any type, including but not limited to a sew-in weft, a clip-in weft, a tape-in weft, a bonding weft, or a beaded weft. While the exemplary device 100 is described as dispensing a weft hair extension 102, the device 100 may be adapted to dispense other types of hair extensions. For example, the device 100 may dispense other hair extensions provided as a continuous strip of tape-in hair extensions. For instance, in embodiments, pre-cut and pre-measured tape sections of the tape-in extension may be dispensed from the device 100.

The spool 114 is a structure around which the weft hair extension 102 is wrapped or wound and can be unwrapped or unwound to remove an amount of the hair extension 102. An outer surface of the spool 114 may include a holder, such as a clip, a slot, an adhesive, or the like, to hold an end of the strip 106 of the weft hair extension 102 in place on the spool 114. The spool 114 has a body with at least one attachment end 116 that couples the spool 114 to the base 108 such that the spool 114 is rotatable (as illustrated by arrow 128). When the spool 114 is rotated, an amount of the weft hair extension 102 can be unwound from the spool 114 and removed (e.g., using the cutting tool 120 described below or another cutting tool, such as scissors). The example spool 114 has a cylindrical body. However, the spool 114 may have a different shape.

The attachment end 116 of the spool 114 is any appropriate structure for coupling the spool 114 to the base 108, while allowing the spool 114 to be rotated. For example, the attachment end 116 may be an opening through which a complementary structure, such as a pole or tab, of the base 108 fits. As another example, the attachment end 116 may be a tab that fits (e.g., is fittable) in a depression or other opening of the base 108. For example, the depression in the base 108 may be shaped to interlock with the tab to allow the spool to be secured to the base 108, while the spool 114 can still be rotated.

In the example of FIG. 1, an additional holder/attachment end 118 holds the spool 114 in place at the top end of the spool 114 and/or provides an additional or alternative attachment point to the base 108. For example, both the attachment end 116 and holder/attachment end 118 may attach to the base 108, or the holder/attachment end 118 may act as the only attachment end (e.g., in an embodiment with the base 108 positioned above the spool 114), while the attachment end 116 acts as a holder for the spool 114.

In some embodiments, the spool 114 is removable and replaceable on the base. For example, the spool 114 may be a replaceable hair extension cartridge, as illustrated in the examples of FIGS. 2 and 3 (described below). By being removable and replaceable, the spool 114 may facilitate quick refills or changing to different hair colors or types without disrupting workflow. For example, a different spool 114 may be installed when a stylist wishes to dispense a weft hair extension 102 with the hair color and length on the different spool 114. When all of the weft hair extension 102 is consumed on the spool 114, a new spool 114 may be obtained and installed, or a new weft hair extension 102 may be wound around the existing spool 114.

The base 108 of the device 100 receives and secures the spool 114, such that a user can rotate the spool 114 (see arrow 128) to obtain a desired amount (also referred to as a width) of the weft hair extension 102. The base 108 may include any appropriate structure for holding the spool 114 in place and allowing the spool 114 to rotate. For instance, the base 108 may be a weighted block with an attachment compatible with the attachment end 116 and/or holder/attachment end 118 of the spool 114. The base 108 may include legs (e.g., tripod legs) for holding the spool 114 above the surface of the ground or a table. The base 108 may include mounting elements (e.g., openings, clamp(s), or other fittings) that allow the base 108 to be mounted to a wall, a table, a rack, a stand, or another support. The base 108 may be sized and shaped to fit in a drawer or attached to a rack. The base 108 may be part of a rotating carousel system that allows different spools 114 to be rotated to a position where a user can rotate the carousel to a desired spool 114 and use the device 100 to obtain a desired amount of the weft hair extension 102.

In some embodiments, the base 108 and the overall device 100 is portable. For instance, the device 100 may be a size, shape, and weight that can be carried by an average person aged 8 to 65. For example, the base 108 may include foldable or collapsible legs that allow the overall footprint of the device 100 to be decreased during transport. As another example, the base 108 may include a clamp that allows the device 100 to be moved to different locations and temporarily secured to a table or other surface at each location.

As also described above, the basin 110 is positioned below the spool 114 and configured to receive ends of the strands of hair 104 of the weft hair extension 102 that is held by the spool 114. The ends of the strands of hair 104 are contained within a region 112 of the basin 110. The basin 110 basin 110 may be coupled directly to the spool 114 (see example of FIG. 2) of to the base 108. The basin 110 reduces the size requirements of the device 100, such that the length 126 of the device 100 may be less than the length 124 of the strands of hair 104 of the weft hair extension 102. In this way, even a long hair extension 102 can be stored in a relatively compact space and with a regular and reproducible footprint that facilitates improved usage of available working space.

The device 100 may include a built-in measuring tool 120. The measuring tool 120 may be coupled to and extend from the base 108 and/or the spool 114. The measuring tool 120 enables a user, such as a stylist, to easily measure a width of the weft hair extension 102 unrolled or unwound from the spool 114. For example, the measuring tool 120 may be a retractable measuring tape or a ruler (e.g., with graded markings indicating a width of the hair extension 102 that has been unrolled or unwound from the spool 114). The measured width of the hair extension may correspond to the length of the strip 106 of the hair extension 102 from a predefined cutting point (e.g., the location of the cutting tool 122, described below). The measuring tool 120 may be coupled at any appropriate position to the base 108 and/or spool 114. The measuring tool 120 may be removable from the device 100.

The device 100 may include a built-in cutting tool 122. The cutting tool 122 may be coupled to the base 108 and/or the spool 114. The cutting tool 122 enables a user, such as a stylist, to easily cut a width of the weft hair extension 102 unrolled or unwound from the spool 114. For example, the cutting tool 122 may be a blade, knife, or scissors (e.g., capable of cutting the strip 106 of the hair extension 102 that has been unrolled or unwound from the spool 114). The cutting tool 122 may be coupled at any appropriate position to the base 108 and/or spool 114. The cutting tool 122 may be positioned to provide a cut at a predefined or desired position (e.g., relative to the measuring tool 120, described above). The cutting tool 122 may be removable from the device 100.

The device 100 may include a cover or case (see also FIGS. 2 and 3) to assist in protecting the weft hair extension 102 from the surrounding environment and increase the shelf life of the weft hair extension 102. The cover may be light-resistant, such that when placed over the spool 114, the cover shields the hair extension 102 from fading due to exposure to light. The cover may be made of the same or similar material as the base 108 and/or spool or a different material. For example, the cover may be an opaque or only partially translucent plastic cover.

In an example operation of the device 100, a stylist wishes to prepare a hair style using several colors and/or lengths of weft hair extensions. To achieve this, the stylist first removes the cover from the device 100. If a spool 114 with a desired hair color and length is not installed on the base 108, the stylist removes the spool 114 and installs a spool 114 with the desired weft hair extension 102. Once the spool 114 with the desired weft hair extension 102 is installed, the stylist rotates the spool (e.g., by pulling the weft hair extension 102 to unwind a section of the weft hair extension 102). The stylist measures the unwound width of the weft hair extension 102 using the measuring tool 120 and cuts the desired width using the cutting tool 122. The stylist may repeat this process of installing different spools 114 with a different desired weft hair extensions 102 and cutting a desired width of the weft hair extensions 102 until all hair colors for the style are obtained. The stylist then uses the obtained weft hair extensions 102 to prepare the hair style. In an alternative operation, the stylist may install each weft hair extension 102 in the client's hair as it is dispensed from the device 100.

As shown in this example operation, the device 100 allows the stylist to more easily and efficiently obtain the desired types of hair extensions for the hair style without wasting materials, as would typically be the case for pre-cut extensions where unused portions are discarded. The use of interchangeable spools 114 also allows different hair extension types to be more easily organized and accessed by the stylist. In contrast, pre-cut weft hair extensions can be difficult to untangle and cut to a desired size. Furthermore, the basin 110 allows the device 100 to take up a relatively small footprint while also providing extra protection to the hair 104 both during use and while stored.

FIG. 2 illustrates an exemplary embodiment of a hair extension cartridge 200. The hair extension cartridge 200 may be used in an embodiment of the device 100 of FIG. 1 in which the spool 114 is directly coupled to the basin 110. In the hair extension cartridge 200, the spool 114 is directly coupled to the basin 110 via one or more connection members 202. The connection members 202 are any structures (e.g., rods, arms, wires, etc.) that connect the spool 114 to the basin 110. In some embodiments, the connection members 202 are molded or additively manufactured arms that connect on one end to the spool 114 and on another end to the basin 110. As with the device 100, the hair extension cartridge 200 may have a length 206 that is less than the length of the hair of the weft hair extension 102.

The hair extension cartridge 200 includes a cover 204 that can be removed and replaced on the hair extension cartridge 200. The cover 204 may couple to the outer edge of the basin 110 to protect the weft hair extension 102 from the surrounding environment and increase the shelf life of the weft hair extension 102. The cover 204 may be the same as or similar to the cover described above with respect to FIG. 1.

In an example operation of the hair extension cartridge 200, the hair extension cartridge 200 is initially stored (e.g., in a drawer, rack, etc.) with the spool 114 under the cover 204. A stylist determines that the weft hair extension 102 on the hair extension cartridge 200 is needed to create a hair style. The stylist removes the cover 204 and attaches the hair extension cartridge 200 to a compatible base (e.g., base 108 of FIG. 1), unwinds a desired amount of the weft hair extension 102, and cuts the desired amount (e.g., using the measuring tool 120 and cutting tool 122 of FIG. 1). The dispensed amount of weft hair extension 102 is then used to create a hair style. The cartridge 200 may be removed from the base, covered, and returned to storage.

FIG. 3 illustrates another exemplary embodiment of a hair extension cartridge 300. The hair extension cartridge 300 may be used in an embodiment of the device 100 of FIG. 1 in which the base 108 is directly coupled to the basin 110. The hair extension cartridge 300 may be stored, when not attached to a base (e.g., base 108 of FIG. 1) in a specially structured container 302. The container 302 includes a first portion 304 and second portion 306 which together form a housing for holding and protecting the hair extension cartridge 300. For example, the first portion 304 may be the same as or similar to the cover 204 described above with respect to FIG. 2, while the second portion 306 may be the same or similar to the basin 110 of FIGS. 1 and 2. However, the first portion 304 and second portion 306 may have any other structure that provides protection to the hair extension cartridge 300. For example, the first portion 304 may be a hanged cover that attaches to the second portion 306.

The container 302 includes a spool attachment 308 raised from an inner surface of the container 302. The spool attachment 308 reversibly (e.g., removably) couples to the hair extension cartridge 300 (e.g., at an end 116 of the spool 114) in a raised position, such that a space 312 is provided below the spool attachment to contain ends of the strands of hair 104. The spool attachment 308 is any appropriate structure for removably holding the hair extension cartridge 300 in a raised position within the container 302. For example, the spool attachment 308 may be an opening through which a portion of the spool 114 fits or a tab or other fitting that fits within the spool 114. As with the device 100, the container 302 may have a length 310 that is less than the length of the hair of the weft hair extension 102, such that the container 302 can be easily and efficiently stored (e.g., in a rack, drawer, etc.) without taking up a large amount of space.

In an example operation of the hair extension cartridge 300 and container 302, the hair extension cartridge 300 is initially stored in the container 302, which may be held in a drawer, a rack, or the like. A stylist determines that the weft hair extension 102 on the hair extension cartridge 300 is needed to create a hair style. The stylist opens the container 302 and attaches the hair extension cartridge 300 to a compatible base (e.g., base 108 of FIG. 1), unwinds a desired amount of the weft hair extension 102, and cuts the desired amount (e.g., using the measuring tool 120 and cutting tool 122 of FIG. 1). The dispensed amount of the weft hair extension 102 is then used to create a hair style. The hair extension cartridge 300 may be placed back in the container 302, and the container 302 may be moved to a storage location.

As used herein, the word "or" refers to any possible permutation of a set of items. For example, the phrase "A, B, or C" refers to at least one of A, B, C, or any combination thereof, such as any of: A; B; C; A and B; A and C; B and C; A, B, and C; or multiple of any item, such as A and A; B, B, and C; A, A, B, C, and C; etc.

The above Detailed Description of examples of the technology is not intended to be exhaustive or to limit the technology to the precise form disclosed above. While specific examples for the technology are described above for illustrative purposes, various equivalent modifications are possible within the scope of the technology. For example, while processes are presented in a given order, alternative implementations may perform routines having steps, or employ systems having processes, in a different order, and some processes may be deleted, moved, added, subdivided, combined, and/or modified to provide alternative or sub-combinations. Each of these processes may be implemented in a variety of different ways. Also, while processes are at times shown as being performed in series, these processes may instead be performed or implemented in parallel or may be performed at different times. Further, any specific numbers noted herein are only examples: alternative implementations may employ differing values or ranges.

The teachings of the technology provided herein can be applied to other systems, not necessarily the system described above. The elements and acts of the various examples described above can be combined to provide further implementations of the technology. Some alternative implementations of the technology may include not only additional elements to those implementations noted above, but also may include fewer elements.

The description and illustration of one or more aspects provided in this application are not intended to limit or restrict the scope of the disclosure as claimed in any way. The aspects, examples, and details provided in this application are considered sufficient to convey possession and enable others to make and use the best mode of claimed disclosure. The claimed disclosure should not be construed as being limited to any aspect, example, or detail provided in this application. Regardless of whether shown and described in combination or separately, the various features (both structural and methodological) are intended to be selectively rearranged, included or omitted to produce an embodiment with a particular set of features. Having been provided with the description and illustration of the present application, one skilled in the art may envision variations, modifications, and alternate aspects falling within the spirit of the broader aspects of the general inventive concept embodied in this application that do not depart from the broader scope of the claimed disclosure.

I claim:

1. A weft hair extension dispenser comprising:

a base;

an interchangeable cartridge that is removable and replaceable, the interchangeable cartridge comprising: a weft hair extension; and a spool comprising a body and first and second flanges disposed at opposing ends of the body respectively; the body having an outer surface, wherein the weft hair extension is wrapped around the outer surface, the first flange defining an attachment end configured to couple the spool to the base such that the spool is rotatable on the base; and a measuring tool extending radially from a top surface of the second flange, wherein the measuring tool is configured to measure a width of the weft hair extension unwrapped from the spool;

a cutting tool coupled to a lower surface of the measuring tool and spaced apart from the second flange, wherein the cutting tool is configured to cut the width of the weft hair extension after being unwrapped from the spool; and a basin positioned below the spool and configured to receive ends of strands of hair of the weft hair extension, such that the ends of the strands of hair are contained within the basin.

2. The weft hair extension dispenser of claim 1, wherein a length of the weft hair extension dispenser is less than a length of the strands of hair of the weft hair extension.

3. The weft hair extension dispenser of claim 1, wherein the attachment end comprises an opening through which a pole or tab attachment of the base fits.

4. The weft hair extension dispenser of claim 1, wherein the attachment end is a tab fittable in a depression of the base, wherein the depression is shaped to interlock with the tab.

5. The weft hair extension dispenser of claim 1, wherein the basin is coupled to the base.

6. The weft hair extension dispenser of claim 1, wherein the basin is directly coupled to the spool.

7. The weft hair extension dispenser of claim 1, wherein the outer surface of the spool comprises a holder to hold an end of a strip of the weft hair extension in place.

8. The weft hair extension dispenser of claim 1, wherein the spool is removable and replaceable on the base.

9. The weft hair extension dispenser of claim 1, wherein the base is mountable to at least one of a wall, table, rack, or stand.

10. The weft hair extension dispenser of claim 1, wherein the device is portable.

11. A device comprising:

a base;

a weft hair extension;

a spool comprising a body and first and second flanges disposed at opposing ends of the body respectively; the body having an outer surface for receiving the weft hair extension, the first flange defining an attachment end configured to couple the spool to the base such that the spool is rotatable on the base; and a measuring tool extending radially from a top surface of the second flange, wherein the measuring tool is configured to measure a width of the weft hair extension that has been unwrapped from the outer surface;

a cutting tool coupled to the base, wherein the cutting tool is configured to enable a user to cut the width of the weft hair extension unrolled from the spool;

a basin positioned below the spool and directly coupled to the base, the basin configured to receive ends of strands of hair of the weft hair extension such that the ends of the strands of hair are contained within the basin, wherein the weft hair extension is wrapped around the outer surface of the body; and wherein during use, the spool is rotated by pulling the weft hair extension to unwrap a width of the weft hair extension, the measuring tool is then used to measure the unwrapped width of the weft hair extension and the unwrapped width is cut at a desired width using the cutting tool.

12. The device of claim 11, wherein a length of the device is less than a length of the strands of hair of the weft hair extension.

13. The device of claim 11, wherein the attachment end is an opening through which a corresponding attachment of the base fits or a tab which fits within the corresponding attachment of the base.

14. The device of claim 11, wherein the spool comprises a holder to hold an end of a strip of the weft hair extension in place.

15. The device of claim 11, wherein the spool is removable and replaceable on the base.

16. The device of claim 11, further comprising a cover fittable over the spool, wherein the cover couples to the basin to protect the weft hair extension held by the spool.

* * * * *